US007293583B2

(12) United States Patent
Arigoni

(10) Patent No.: US 7,293,583 B2
(45) Date of Patent: Nov. 13, 2007

(54) "COUNTDOWN TIMER" AUTOMATIC WATER LIMITING SUPPLY SHUT OFF SAFETY VALVE FLO-CONTROL SYSTEM

(76) Inventor: John Henry Arigoni, 924 River Rd., Clarksburg, MA (US) 01247

( * ) Notice: Subject to any disclaimer, the term of this patent is extended or adjusted under 35 U.S.C. 154(b) by 0 days.

(21) Appl. No.: 11/303,527

(22) Filed: Dec. 16, 2005

(65) Prior Publication Data

US 2006/0162788 A1 Jul. 27, 2006

Related U.S. Application Data

(60) Provisional application No. 60/646,853, filed on Jan. 25, 2005.

(51) Int. Cl.
*F16K 31/48* (2006.01)

(52) U.S. Cl. ..... 137/624.11; 137/624.12; 4/427

(58) Field of Classification Search ..... 137/624.11; 4/427

See application file for complete search history.

(56) References Cited

U.S. PATENT DOCUMENTS 4,195,374 A * 4/1980 Morris et al. ..... 4/427
6,543,479 B2 * 4/2003 Coffey et al. ..... 137/624.11
6,671,893 B1 * 1/2004 Quintana et al. ..... 4/427
7,000,627 B1 * 2/2006 Johnson ..... 137/624.11

* cited by examiner

*Primary Examiner*—Kevin Lee

(57) ABSTRACT

An electronically controlled electro-mechanical device designed to limit a finite amount of water per flush to a tank reservoir of the common household toilet, or tank-less toilet or urinal, providing positive shutoff of water flow and anti-siphon backflow prevention. The toilet is flushed, the flush lever activates an attached tilt switch, the tilt switch actuates the countdown timer by means of electrical linkage, the countdown timer in turn activates the solenoid valve by means of electrical connection. The water enters the solenoid valve, passing through the valve and on to the float valve mounted to the toilet tank for fill up. The Countdown timer counts down from the full minutes and seconds set to 00:00 and shuts off the solenoid valve and ultimately the flow of water. The Countdown timer then resets itself to the time set in memory for the next flush operation. A float eliminator may be affixed to the toilet tank replacing the float valve, then connected to the solenoid valve. For the purpose of adjusting the volume of water per flush the Countdown timer can be programmed from 00:00 minutes and seconds to 99 minutes and 55 seconds. The average toilet will need approximately 2 minutes. It is suggested that the user flush and time his toilet prior to installation of the electro-mechanical solenoid valve unit and add five seconds to assure the proper volume of water per flush.

16 Claims, 3 Drawing Sheets

"COUNTDOWN TIMER" AUTOMATIC WATER LIMITING SUPPLY SHUT OFF SAFETY VALVE FLO-CONTROL SYSTEM

I, claim priority filing date of Jan. 25, 2005 of provisional Application No. 60/646,853

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND FIELD OF INVENTION

Current U.S. Class: 4/415: 4/366; 137/436; 210/170; 713/322

Intern'l Class: EO3D 001/00; C02F 003/02; G06F 001/04

REFERENCES CITED

U.S. Patent Documents

U.S. Pat. No. 6,903,766 Jun. 7, 2005 Silverbrook, et al. . . . 348/211.4; 348/333.06; 348/207.2; 396/264

U.S. Pat. No. 6,989,721 May 24, 2005 Schmidt . . . 713/322; 713/501; 713/600; 455/205; 455/502

U.S. Pat. No. 6,178,569 Jan. 30, 2001 Quintana . . . 4/427; 4/406; 73/304C; 137/392; 137/558; 340/620

U.S. Pat. No. 5,752,281 May 19, 1998 Conner . . . 4/427; 4/415

U.S. Pat. No. 5,524,299 Jun. 11, 1996 Dalfino . . . 4/415, 4/366; 137/410

U.S. Pat. No. 5,440,756 Aug. 15, 1995 Weir . . . 4/415; 137/400

U.S. Pat. No. 5,185,891 Feb. 16, 1993 Rise . . . 4/324; 4/314; 4/415; 33/531; 33/567

U.S. Pat. No. 5,230,104 Jul. 27, 1993 Ocampo . . . 4/415; 4/367; 4/434

U.S. Pat. No. 5,031,254 Jul. 16, 1991 Rise . . . 4/324; 4/415

U.S. Pat. No. 4,901,377 Feb. 20, 1990 Weir . . . 4/415; 137/400

U.S. Pat. No. 4,916,762 Apr. 17, 1990 Shaw . . . 4/366; 4/415; 222/16; 222/20; 251/230

"The present invention relates to the fill and flush valves of ordinary toilets with and without holding tanks or reservoirs, more specifically to improve and expand the scope and function of the toilet fill and flush valves addressing the issues of water shut off, water conservation, environmental preservation, water damage prevention, anti-siphon, back flow prevention, and to reduce water production and sewage treatment costs due to leaking toilets and urinals."

DISCUSSION OF PRIOR ART

Toilet systems, of the reservoir tank type generally installed in American homes, are connected to the potable water supply. The average American home has at least one of these toilets, each of which uses approximately one and one half to three and a half gallons, or more, of water per flush, depending on the age of the toilet.

Generally, toilet fill valves are made with a float mechanism causing the valve to open when the toilet is flushed as the water leaves the tank and to close once the float is lifted by the water when the tank or reservoir becomes full.

Typically these toilet fill valves work fairly well but have several drawbacks that lead to wasting of water, overflow, and leaks. These drawbacks result in a myriad of problems from wells running out of water, dirt being introduced into the water lines from low water levels in shallow wells, and septic system failure, to high water and sewage bills for those on public water supply and sewage systems to water damage to the floor of a bathroom, and ceilings and walls of a downstairs room to remediation of mold and mildew.

To address these issues manufacturers and inventors began to develop other types of toilet fill valves such as the "Toilet Tank Water Flow Shutoff Apparatus For Preventing Leakage And Overflow, U.S. Pat. No. 5,524,299 of Dalfino, which uses tilting trays to control water level and shutoff of the water supply. Though this device can effectively cause shut off, it tends to have many external moving parts subject to mechanical failure and also uses most of the toilet tank area and servicing as well as installation require more intensive labor and increased expense.

A quite different approach is taken with the Revised Automatic Water Shut Off For Stuck Open Flush Valves In Toilet Water Tanks, U.S. Pat. No. 5,440,765 of Weir, which utilizes a two cylinder system to force the float upwards to shut off the water supply should a continuous flow or wasting of water occur. Similar to the above is the Toilet Bowl Automatic Flow Shut Off and Water Saver Device, U.S. Pat. No. 4,901,377 of Weir, that accomplishes the same results with a bellows assembly that lifts the float when the tank remains empty for a period of time beyond that of normal flushing. Both of the foregoing devices utilize a large portion of the toilet tank area to the right of the flapper valve causing access to the flapper to be flanked on all sides and tends to limit service space for repairs, causing repairs to be costly and labor intensive.

Addressing the issues of conservation, the Water Conserving Toilet Flush Control, U.S. Pat. No. 5,031,254 of Rise, is a device that addresses preventing the wasting of water achieved by limiting the lifting action of the flapper and restricting or preventing automatic operation of flushing. Relatively similar in operation the Water Conserving Toilet Flapper Valve Control, U.S. Pat. No. 5,185,891 of Rise, which in effect limits the height that the flapper can be lifted achieving the same results as the prior invention of Rise when the flush lever is activated. Though both Rise controls address stopping automatic function of the flapper and limiting the flappers movement they do not address wasting of water when the flapper becomes defective by means of blowout, tear or just ordinary wear of the seal, the results of which could lead to a continuous loss of water to the sewer or overflow and water damage.

Fill valves designed to save water such as the Toilet Water Preservation Device U.S. Pat. No. 5,230,104 of Ocampo, tend to use the flow of wasting water redirecting it to a secondary float device that in turn lifts the primary float device. This device though it appears to be quite functional also renders much the same results as the Weir devices utilizing or cluttering tank space hindering and causing labor intensive costly service when repairing or replacing the flapper or primary float valve. The secondary float fill valve is also still subject to fail in much the same way as the primary float fill valve.

Adaptations to fill valves such as the Shut-off Device For The Float Valve Assembly Of A Toilet, U.S. Pat. No. 5,752,281 of Conner, designed so that the rotation of the lever arm causes the float valve assembly to rotate to a stop position and stop the flow of water to the toilet tank in the event that the float fails to raise up for any known reason appears as an entirely different approach. While this system would effectively shut off the flow of water it is possible that with the rotating movement of the float assembly, it could eventually cause leakage and overflow from wear due to excessive movement.

Most of these devices work fairly well shutting off the water, while addressing anti-siphoning of water but do not adequately address backflow prevention, wasting of water if the float fails to be elevated by the water or lack thereof, and or overflow of the bowl or a leaky gasket between tank and toilet. Recently developed toilet fill valves address one or more of these problems.

One of the more recent toilet fill valves the FlowManager™ AquaOne Technologies, Inc., addresses most of these problems, incorporates the use of electronic water sensors that detect leaks and overflow. The major drawbacks of such devices are that they require regular and periodical battery maintenance and replacement as well as regular cleaning of the sensor devices that appear as necessary clutter and are actually in the way of cleaning the bowl and or the floor. Additionally, the cleaning of the sensors and the chemicals used, both cleansers and antibacterial toilet additives can cause premature failure. Although the sensor in the bowl will effectively stop overflow of the bowl or bowl in households with children who might lose a toy or otherwise plug the bowl, a floor sensor could present a problem with flushing where bath water is accidentally splashed on it or if a child accidentally misses the bowl and wets the sensor. Electronic valve systems such as the above generally utilize a normally open solenoid valve so the batteries will last a long time if the valve is not triggered shut by a sensor; however, if the valve is triggered shut in the case of a flapper leak the batteries would not last very long which would in short time lead to water running to the sewer or worse yet water damage if the bowl was plugged.

Addressing the issues of toilet tank fill and flush problems and wasting of water with control devices has made significant progress in the Positive Shut-off, Metered Water Control System For Flush Tanks, U.S. Pat. No. 4,916,762, by Shaw. This device utilizes the flow of water to turn a vaned water wheel. A worm gear attached to the water wheel drives a spur gear which in turn rotates a second spur and worm gear. The worm gear of the secondary or intermediate gear assembly then engages a spur gear seated in a ratchet and cam assembly. The cam of the ratchet cam assembly controls both opening and closing of a stopper. The cam is ratcheted to the start position by a pawl connected to the flush lever of the toilet to cause the stopper to dislodge from its seat when the toilet is flushed to allow water to pass or flow, driving the water wheel, which causes the cam to turn and reseat the stopper after the desired amount of water has been metered through the system. Although this device is impressive it has the possibility of lockup of the drive system.

While addressing anti-siphon ability as with the other devices heretofore mentioned this particular device also addresses backflow prevention when the stopper is reseated by water pressure, but will not stop backflow if water pressure is lost during fill up. As previously discussed above, this invention utilizes a start arm with a pawl to ratchet forward the cam to allow a predetermined volume of water by notches fixed in the cam. While this method appears to be able to work well a shortcoming to address is each toilet with a different tank capacity would need a special cam for that particular volume of water. Additionally, this ratchet cam system does not address the ability to adjust the volume of water metered so a 3.5 gallon valve will not service the 1.5 gallon tank of a newer toilet or vise versa. In other words one size does not fit all due to the arrangement of the fixed setting or position of notches in the cam and the ratcheting mechanism.

Due to the fact that until the present invention no electronic timer control for metering water flow to toilets has been developed, the search for timer modules is made in unrelated fields to the effect that the Timer module for compact printer system, U.S. Pat. No. 6,903,766, of Silverbrook, et al. though it is applied to printer systems this unit can be preset to spool documents, pictures, images for printing as well as captures images by specific intervals, however it does not apply itself to the present invention's countdown timer control where the timer control is preset to be programmed by the user for specific on and off control of electronic devices such as the solenoid valve discussed below, triggered by a tilt switch.

In addition to searching the Timer module for compact printer systems, I felt it necessary to search at least one other timer or clock system thus for the purpose of eliminating any infringements the Clock generation systems and methods, U.S. Pat. No. 6,898,721, of Schmidt, was searched to compare the timer controlling processor. In the clock generation systems and methods each of the processing units has a clock input to control the performance of the unit, wherein the processors are all receiving input from a common master clock via a transceiver. This unit is in effect designed to generate a clock signal to speed up performance of computerized functions and processors and thus does not relate to the present invention or it's application.

SUMMARY OF THE INVENTION

Accordingly, the reader will see in FIGS. 1 and 2 the instant invention, a countdown timer, and in FIGS. 1 and 4 a solenoid safety valve, comprising a safety valve system designed to operate in conjunction with or without a float assembly by providing a limited amount of water to any given toilet during flushing sufficient to allow a complete flush and performing a positive shut off of the water supply every time a numeric display shown in FIGS. 1 and 2 displays 00-00 even if the flushing operation should fail for any reason. Should a toilet float, flapper, or other tank-less flushing mechanism fail to operate properly and only after the maximum amount of water limited by time control has passed to the tank of a toilet, a rundle of a tank-less toilet or urinal, the electronically controlled solenoid valve of the instant invention will close and prevent the flow of water for the purpose of eliminating running or wasting of water, preventing overflow and or water damage. Additionally the valve is normally closed and doubles as a backflow prevention check valve to stop any possible reverse flow in case of water pressure loss. The volume limiting shut-off action of the present invention can be used on any common or uncommon toilet tank of any dimension, comprising a time programmable countdown timer controller shown in FIGS. 1 and 2, which is turned on by means of a tilt switch shown in FIGS. 1 and 2B, connected to said timer, by means of a tilt switch transmission wire, and a tilt switch plug.

A solenoid safety valve is also connected to said timer by means of a valve power feed wire depicted in FIGS. 1 and 2B, by means of a valve power feed wire plug. The solenoid safety valve is positioned within the water feed line shown in FIG. 1, by means of two compression fittings to start and stop the flow of water from the feed line angle stop to the toilet during operation.

The tilt switch is attached to the toilet flush rod shown in FIG. 1, by means of two wire ties, when the flush lever is depressed the tilt switch causes the countdown timer to start the preset timed event which in turn sends power to the solenoid safety valve by means of the valve power feed wire and plug connection. As said valve opens the water flows from the water feed line into the inlet of said valve through said valve and out the outlet of said valve continuing on into the toilet float valve assembly, or through a float eliminator to fill the toilet tank as normal, or directly to the rundle of a tank-less toilet or urinal.

Ideally, if used the float assembly affixed to the uppermost portion of the float valve body will successfully activate shut off five seconds prior to the conclusion of the preset countdown timed closing of the solenoid valve installed in the toilet water feed line. The countdown timer will reset to its preset time and wait for the flush lever to be depressed for the next flush. Any toilet tank that has a lesser volume capacity than the capacity set by time will cause the float valve to elevate and effectively shut off the flow of water and the countdown timer will finish it's cycle anyway. It is suggested for the purpose of equal control of water flow that a user should flush the toilet and time the flush prior to installation and set the control for five seconds longer than the actual flush to eliminate excess over flush water if the toilet float or flapper fails. Should the float or flapper fail to close, the tank would call for more water than allowed, the countdown timer will shut off the valve and flow of water when the time limit is reached simultaneously the volume of water will have been reached effectively conserving water and reducing the volume of sewage waste caused by toilets that continuously run. In effect and operation the function of the instant invention is to shut off the water supply after every timed flush irregardless of any malfunction of the toilet flushing system for any reason, ultimately rendering all other sensor systems, gadgets, duel float controls, and other anti-overflow devices obsolete, while preventing overflows, flooding and excessive waste of water and generation of unnecessary sewage.

The reader will note that there are two interchangeable water delivery systems for toilets with tanks, one being the common float assembly and the other being a float eliminator. When using a common float assembly the countdown timer and solenoid valve can be used universally irregardless to capacity. The second delivery system is the float eliminator. This system replaces the float valve and attaches to the toilet tank the same way as the float valve assembly. However this system is simply a channeling device that directs the water downward towards the base of the tank for fill up from a delivery tube, with a replenish tube shaft at its upper most portion for removeably connecting the replenish tube to restore the water level in the bowl during fill up. The float eliminator has been designed and described in the present inventor's prior invention the Toilet King, U.S. patent application Ser. No. 11/090,602, and needs no further discussion here.

OBJECTS AND ADVANTAGES

Accordingly, being designed to address the problems of toilets that have been discussed with the prior art, several objects and advantages of the present invention are:

(a) to provide a limited supply of water by timed volume to any given flush mechanism or toilet tank per flush irregardless of a flapper or float malfunction;

(b) to provide a failsafe positive shutoff of the water feed line when the maximum limit of water by timed volume has been reached;

(c) to prevent overflow and limit the extent of water damage from a plugged toilet or sewer drain;

(d) to conserve water, and to prevent wasting of water;

(e) to reduce municipal water production and waste water treatment costs;

(f) to reduce the production of unnecessary sewage pollution into the environment;

(g) to provide a positive means of anti-siphon and backflow prevention.

Further objects and advantages are to provide a cost-effective, easy to install toilet fill valve that will not interfere with servicing of other toilet tank parts. For instance with the present invention should the flapper valve not seat properly or worse yet rupture the water supply will be shut off and the toilet tank will be left empty and ready for easy no muss or fuss servicing. A new flapper can be installed or a leaky flapper can be adjusted without taking too much time for cleanup, and once the repair is complete all that is necessary to return to normal flushing operation is to activate the flow of water by depressing the flush lever of the toilet tank and the tank will fill up for the next flush. One could even completely remove the toilet without a water mishap simply by unplugging the valve 44, from the countdown timer 29 as the valve is normally closed.

BRIEF DESCRIPTION OF SEVERAL VIEWS OF THE DRAWING

The present invention will be better understood from the following detailed description as depicted in the drawings in which like reference numerals refer to like parts; closely related figures have the same number but different alphabetic suffixes.

DETAILED DESCRIPTION OF THE INVENTION

The following description is provided to enable any person skilled in the art to make and use the invention and sets forth the best modes contemplated by the inventor for those so skilled to do so.

Figure 1:
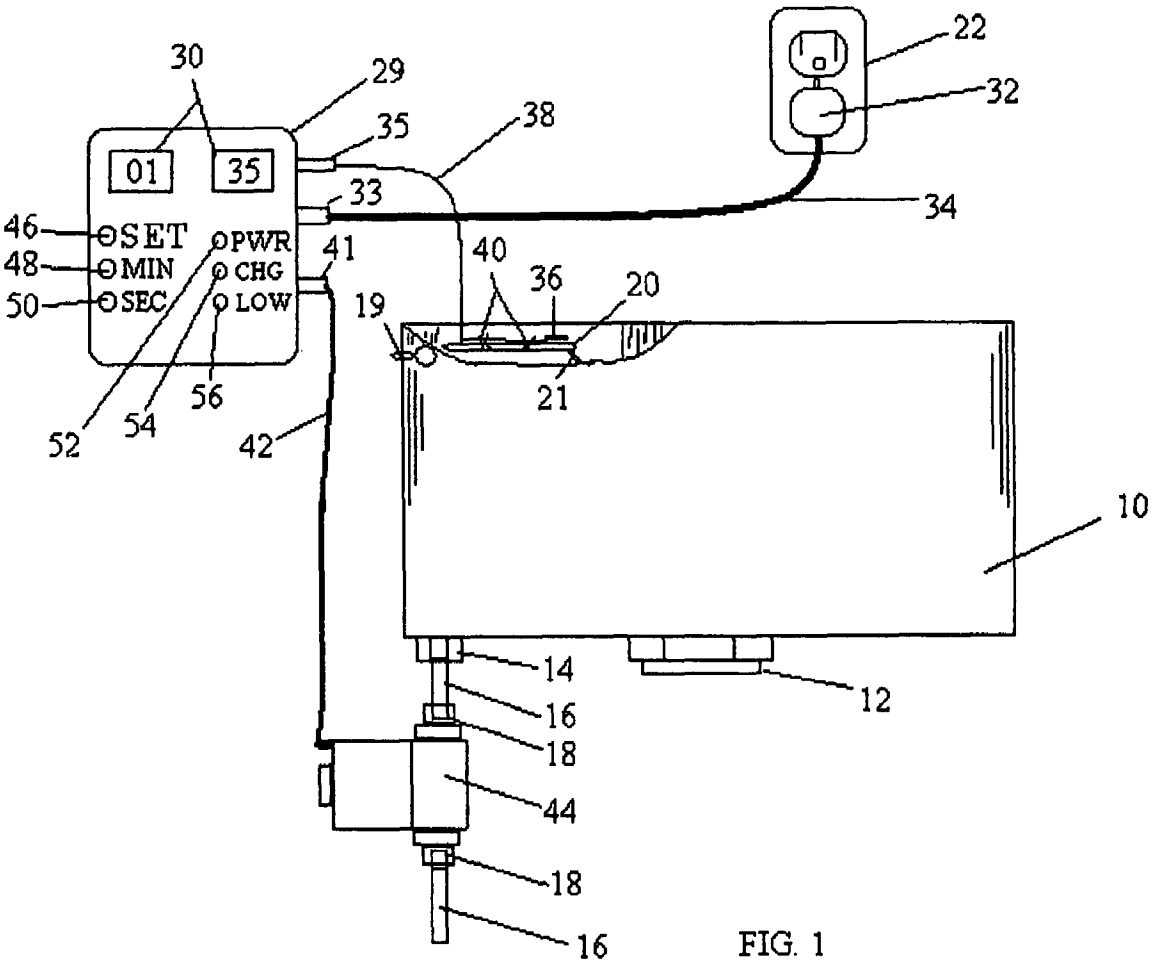
FIG. 1 is a front partial cutaway view of a typical conventional toilet tank with the tank lid removed, incorporating the Countdown Timer automatic water limiting, supply Shut off Safety Valve flo-control system of the present invention.

FIG. 1 is a front view of a conventional toilet tank 10, of the type universally found in most homes in the United States and North America, which is fitted with a Countdown Timer 29, and a Solenoid Safety Valve 44, in accordance with the present invention. In the conventional home toilet, a ball cock assembly comprising a float arm, and float ball is mounted at the upper end of a water tube for closing an inlet valve via a mechanical linkage when the tank is filled to a predetermined level. In the present invention a float valve assembly is left unchanged being mounted to the tank in its usual fashion.

The illustrated toilet tank comprises a toilet tank 10 with a float valve inlet 14, extending through the left rear bottom of the tank 10. Water supply is introduced by means of a water feed line 16, which is connected by known means of a standard sized fitting as currently used with flush tanks, providing a sealable mount to the tank 10. A Solenoid Safety Valve 44, is fitted into the water feed line 16, by means of two compression fittings 18. Water received in tank 10, which exceeds the tank's design capacity spills into a standard overflow tube wherefrom it is discharged to the bowl through the main tank outlet 12, which is normally closed by a standard flapper. When water from tank outlet 12, is introduced into toilet bowl the level of water in bowl is raised until it exceeds the waste outlet of the flush trap causing the water to flow from bowl by siphoning action.

Figure 2B:
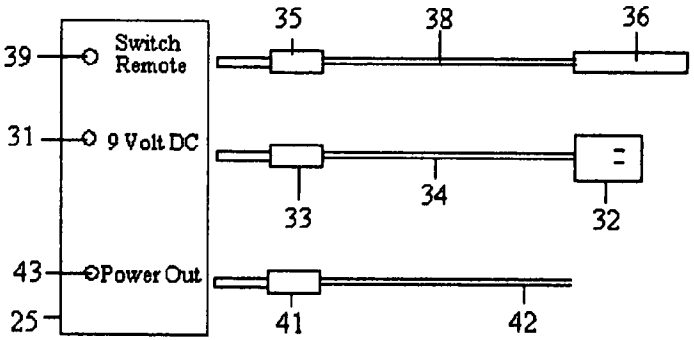
FIG. 2B is a side view of the Countdown Timer of the present invention.

As demonstrated in FIG. 1 and again in FIG. 2B, the solenoid safety valve 44, is electronically connected to the countdown timer 29, by means of a valve power feed plug 41, and a valve power feed wire 42, to open the valve 44, during operation.

FIG. 1 shows, a flush handle 19, located in the upper left front area of the tank 10, used to activate the flushing operation of the toilet. When depressed the flush handle lifts a flush rod 20, lifting open the flapper by means of a flapper flush linkage 21, simultaneously the flush rod 20, activates a tilt switch 36, connected to said flush rod 20 by means of two wire ties 40. Said tilt switch 36, is electronically connected to said countdown timer 29, by means of a tilt switch plug 35, connected to a tilt switch transmission wire 38, which activates the countdown timer 29, allowing water to flow to the tank 10, by electronically opening the Solenoid Safety Valve 44, for a time period set by the user sufficient to allow for a complete flush.

As shown in FIG. 1, the countdown timer has three buttons; the first is a set button 46, the second is a minute button 48, and the third is a second button 50. Although self explanatory the operation and function will be discussed a little later on.

Also shown in FIG. 1 the reader will note there is a power indicator LED 52, a charge indicator LED 54, and a low battery LED 56, though easily understood, the purpose and function will be discussed a little later on.

A wall transformer 32, which is plugged into a wall outlet 22, is connected to the countdown timer 29, by means of a wall transformer power cord 34, a wall transformer plug 33, and a wall transformer plug receiver 31, mounted solidly to a enclosure side 25 as depicted in FIG. 2B.

Figure 2:
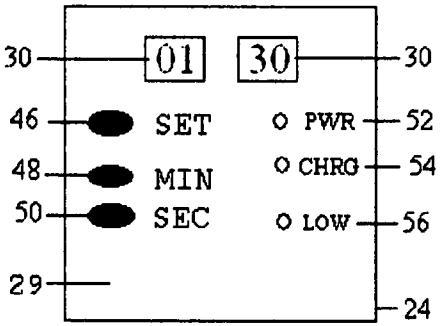
FIG. 2 is a front view of the Countdown Timer of the present invention.

FIG. 2 is a front view of the countdown timer 29, as described in FIG. 1. The preferred embodiment of said countdown timer 29, is comprised of an enclosure front 24, consisting of two equal sized numeric displays 30, to allow the user to program and view the run time and see the running countdown when activated. The countdown timer 29, is turned on and programmed by means of three control buttons. The control buttons consist of a set button 46, colored red, a minute button 48, colored green, and a second button 50, colored yellow, located below and slightly to the left of the numeric digital display 30. To turn on the countdown timer 29, the operator or user will depress and hold the second button 50, then depress the set button 46. To set the running time for countdown the user will press the set button 46, until the numeric displays 30, flash 00 and 00. The user will then set the minute run time by depressing the minute button 48, once for each minute desired and then depress the second button 50, once for every five (5) seconds desired. Once the time has been selected the user will then depress the set button 46, to commit the run time desired to memory.

To the right and below the numeric displays 30, the user will find three indicator LEDs, the uppermost being a power indicator LED 52, colored red when lit to indicate that a wall transformer 32, is connected to the countdown timer 29. The middle being a charge indicator LED 54, colored green when lit to allow the user to see when the countdown timer 29, is in charge mode. The lower most being a low battery indicator LED 56, colored yellow to allow the user to see the condition of the battery.

Figure 2A:
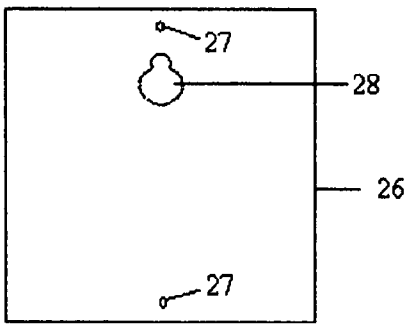
FIG. 2A is a rear view of the Countdown Timer of the present invention.

FIG. 2A is a rear view of the enclosure back 26, of the same dimensions and mating the enclosure front 24, consisting of two enclosure screws 27, located center from side to side and in from top and bottom edges sufficient to hold said enclosure front and back securely together while accommodating the electronics within, and keeping in place two enclosure sides 25, of the same dimensions. One side being without plug receivers, the other side being with plug receivers as depicted in FIG. 2B.

As depicted in FIG. 2A in the rear view of the enclosure back 26, the reader will find a wall hanger hole 28, for mounting to a wall with a wall anchor screw (not shown).

FIG. 2B is a side view of the countdown timer 29, depicting the enclosure side 25, with left and right sides being of the same dimension. The difference between the two sides is that the right enclosure side 25, is fitted with a tilt switch plug receiver 39, a wall transformer plug receiver 31, and a valve power feed plug receiver 43.

Figure 3:
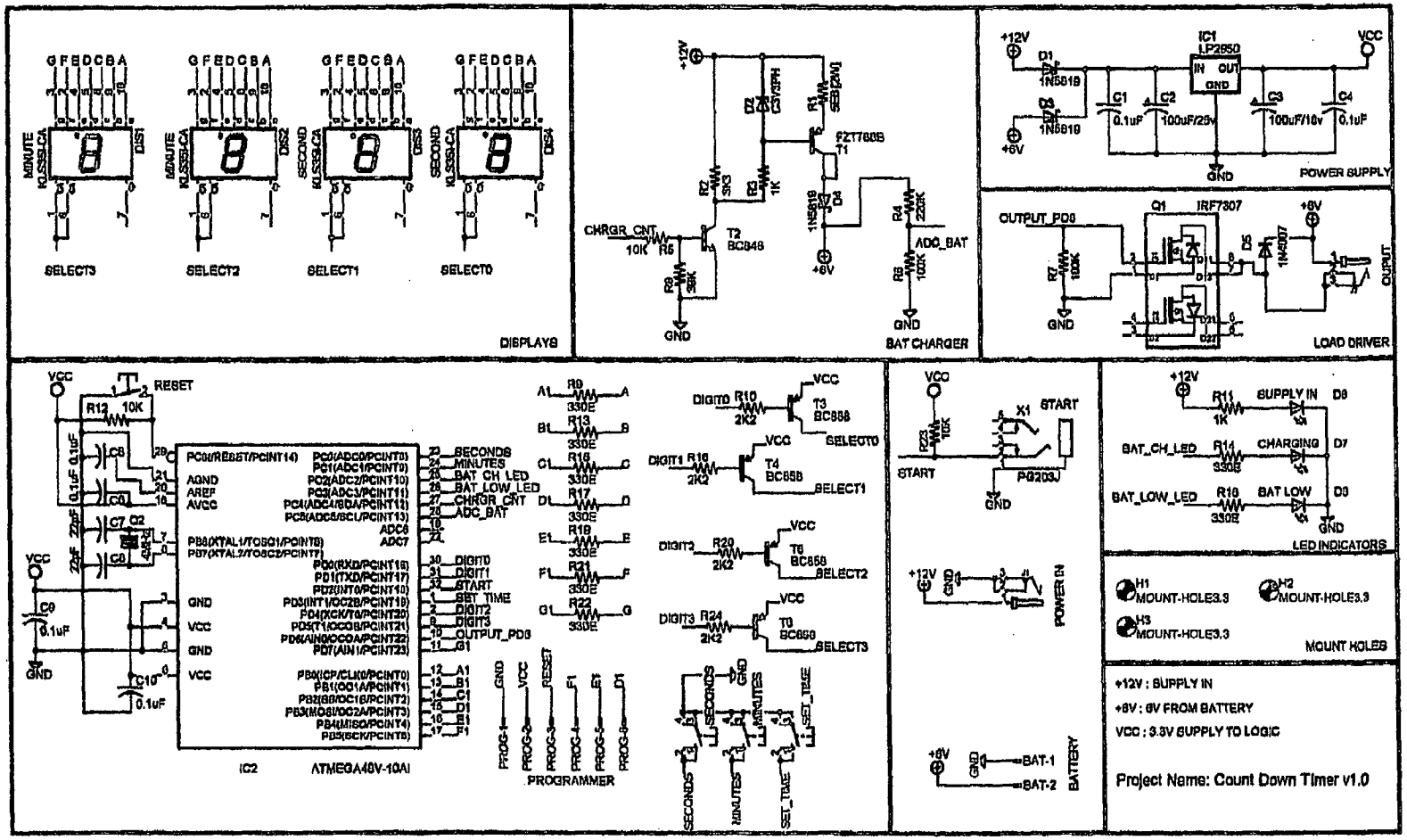
FIG. 3 is the Countdown Timer schematic of the present invention.

FIG. 3 is the Countdown Timer schematic of the present invention as described hereafter by: Naveen Negasha, TronicsZone as per consultant's contract for hire.

Countdown Timer Parts List below itemizes the existing electronic components used as depicted in FIG. 3 showing the Countdown Timer schematic of the present invention.

Countdown Timer Parts List

| Qty | Part Name | Value | PBC Marking |
|---|---|---|---|
| 3 | Switch, tact, 4 pin, (12 mm) | | MINUTES, SECONDS, SET_TIME |
| 1 | Switch, tact, 2 pin | | RESET |
| 2 | Connector, Power, coaxial 2.1 mm | | J1, J2 |
| 1 | Solder points | | BAT |
| 1 | Connector, relimate, 6 pin | | PROG |
| 6 | Capacitor, SMD, 0603 | 0.1 uf | C1, C4, C5, C6, C9, C10 |
| 2 | Resister, SMD, 0603 | 1k | R3, R11 |
| 1 | Diode | 1N4007 | D5 |
| 3 | Diode | 1N5819 | D1, D3, D4 |
| 4 | Resister, SMD, 0603 | 2K2 | R10, R16, R20, R24 |
| 1 | Resister, SMD, 0603 | 3K3 | R2 |
| 1 | Crystal, HC49 | 4 MHz | Q2 |
| 1 | Resistor, CFR, 2 W | 5E6 (2 W) | R1 |
| 3 | Resistor, SMD, 0603 | 10K | R5, R12, R23 |
| 2 | Capacitor, SMD, 0603 | 22 pF | C7, C8 |
| 1 | Resistor, SMD, 0603 | 39K | R8 |
| 2 | Resistor, SMD, 0603 | 100K | R6, R7 |
| 1 | Capacitor, polarized | 100 uF/16 v | C3 |
| 1 | Capacitor, polarized | 100 uF/25 v | C2 |

-continued

Countdown Timer Parts List

| Qty | Part Name | Value | PBC Marking |
|---|---|---|---|
| 1 | Resister, SMD, 0603 | 220K | R4 |
| 9 | Resistor, SMD, 0603 | 330E | R9, R13, R14, R15, R17, R18, R19, R21, R22 |
| 1 | IC | ATMEGA48V-10AI | IC2 |
| 1 | LED, Yellow, 3 mm | BAT LOW | D8 |
| 1 | Transister, SMD, SOT23 | BC848 | T2 |
| 4 | Transister, SMD, SOT23 | BC858 | T3, T4, T5, T6 |
| 1 | Diode, Zener | C3V3PH | D2 |
| 1 | LED, Green, 3 mm | CHARGING | D7 |
| 1 | Transister, SMD, SOT223 | FZT788B | T1 |
| 4 | Display, Common anode | KLS351-CA | DIS1, DIS2, DIS3, DIS4 |
| 1 | MOSFET, DUAL | IRF7307 | Q1 |
| 1 | IC | LP2950 | IC1 |
| 1 | Connector, Stereo socket | PG203J | X1 |
| 1 | LED, Red | SUPPLY IN | D6 |
| 1 | PCB | CNT-DN-TMR-1.0 | |
| 1 | Battery | 6 V, 1.3 Ah | |
| 1 | Output Cable | — | |
| 1 | Tilt switch cable assembly | — | |

Count Down Timer—Hardware Description

Document Version Date Description v1.0 25 Aug. 2005 First release of this document By Naveen Negasha, TronicsZone as per contract for hire.

Table of Contents

1. Power Supply, Voltage Regulator, Battery Charger
2. Micro-controller
3. The Displays
4. The O/P Load Driver
5. The User Interface 1. Power Supply:

Voltage Regulator:

The circuit works at a regulated 3.3v DC. A voltage regulator LP 2950 is used for the purpose of regulating the 9v DC input. A battery backup is also provided for smooth operation of the Timer. The Regulator is supplied with, both the voltages, from battery (6v) and the external power source (9v). These are fed to the regulator through two Diodes (D1 and D2). D1 will avoid the external power source from loading the Battery, and the D2 will avoid the high voltage input directly fed to the Battery. The filter capacitors C1-C4 are provided at the input and the output of the Regulator.

Battery Charger:

The voltage across the battery is continuously monitored by the Micro controller for Over/Under Voltage protection to the Battery. If the same is found dropped bellow the pre-set threshold of 5.75v, the "BAT LOW" (YELLOW) LED will be ON. The Charger will be on whenever the Battery voltage reaches 5.2v, and as an indication the "CHARGING" (GREEN) LED will be ON. The Charger consists of two transistors T2 and T3. The Charger Control from the Micro Controller will go high as soon as the voltage across the battery drops to 5.2v. This will put the T1 in ON state, now the R3 (1K) and the Zener Diode D3 (2.7v) together will provide a constant voltage at the base of T1. The T1, while it is ON, will provide the battery with a constant current (Ich) which can be calculated as per the following Equation.

$$Ich=(Vz-0.7)/Re$$

Ich: The Battery charging current

Vz: The Voltage across the Zener Diode

Re: The resistance connected at the Emitter of T1

The CHARGING LED is connected to the collector of the T1; so that when ever the Charger is ON and the external power source is connected the LED will indicate the charging.

2. Microcontroller:

An Atmel AVR series microcontroller "ATMEGA48" is used as a processor in this project. The microcontroller forms the brain of the circuit and it controls all the functions of the Count down timer including battery charging, count down, sensing tilt switch, setting the timer, controlling the load, controlling the LEDs etc.

3. The Displays:

The Count down timer has four common Anode type 7-Segment Displays, to display the Minutes and Seconds. These are multiplexed by four PNP Transistors (T3-T6). The seven segments are connected to the Micro Controller through current limiting resistors.

4. The O/P Load Driver

The system can drive a load with the rating of 6v/2 A during the Count Down. The OUTPUT will be supplied from the battery. A fully charged (6.9v) battery will serve the Load nearly 20 to 30 Minutes @ 6.0v/2 A. The Load is switched On/OFF through an N-Channel FET (Q1) which has a current rating up to 3A. The resistor R7 will always keep the Gate at the GND potential, so that the load is disconnected as long as the output from the controller is LOW. As soon as the Gate goes high the FWT will be put ON, and the Load will be served with the 6 v from the Battery. The Load will be ON during the Count Down, and will be put OFF when the Count reaches "00 00". During the Count Down the Battery Charger will be put OFF.

5. The User Interface

The "Count Down Timer" has been provided with three (3) "Push to On" type switches, which are labeled as "SET TIME", "MINUTES", and "SECONDS". Three LEDs, which are labeled as "POWER", "CHARGING" and "BAT LOW" are also provided for indicating the various Power statuses. The User Manual can be referred for more details. The user interface is entirely controlled by the microcontroller.

The following Countdown Timer Flow Chart below submitted By Naveen Negasha, TronicsZone, as per contract for hire with the schematic and components parts list shows the flow of current and function of components as described above.

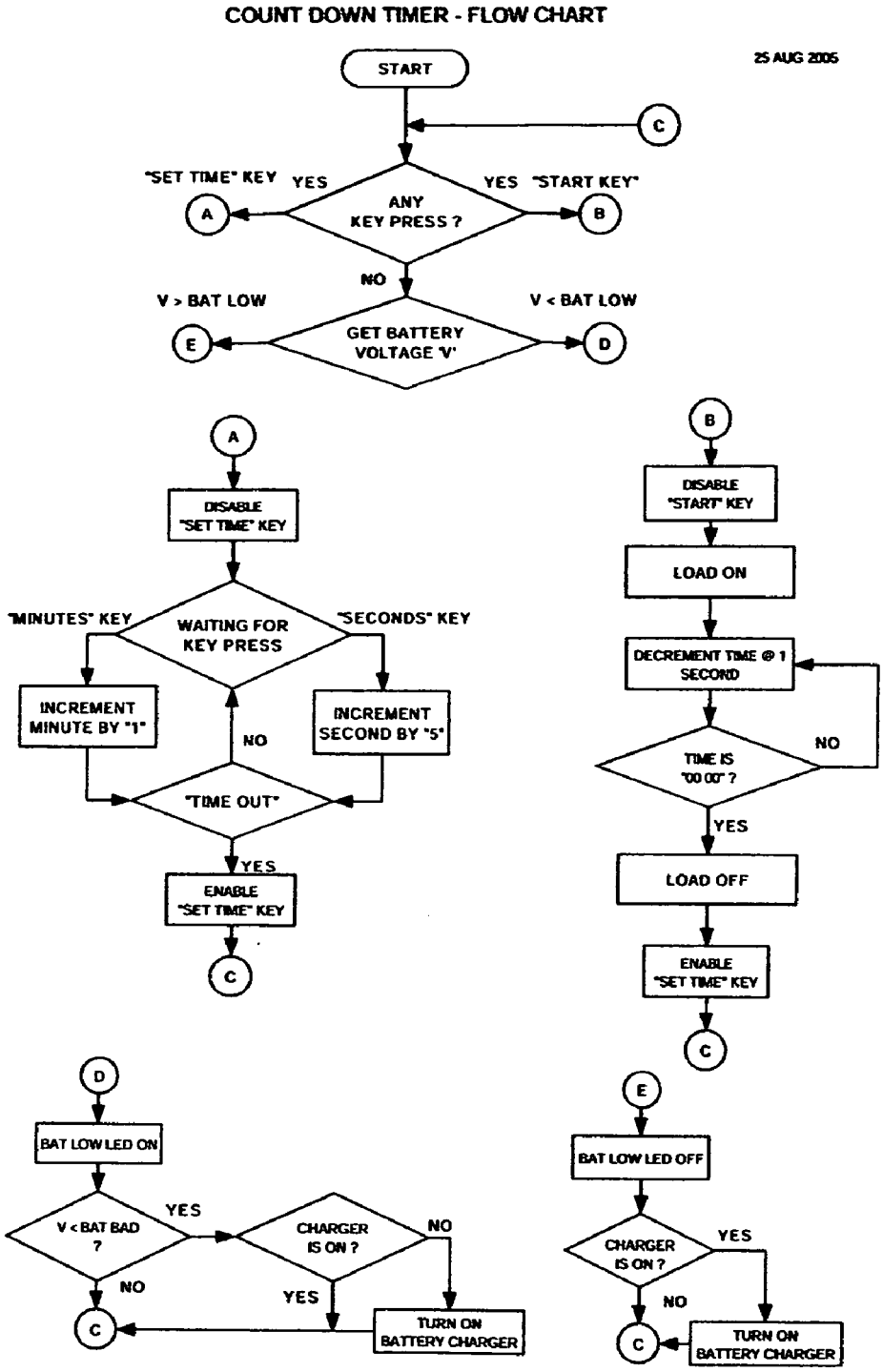
COUNT DOWN TIMER - FLOW CHART
25 AUG 2005
START
C
"SET TIME" KEY
YES
ANY KEY PRESS ?
YES
"START KEY"
A
B
NO
V > BAT LOW
V < BAT LOW
GET BATTERY VOLTAGE 'V'
E
D
A
DISABLE "SET TIME" KEY
"MINUTES" KEY
WAITING FOR KEY PRESS
"SECONDS" KEY
INCREMENT MINUTE BY "1"
INCREMENT SECOND BY "5"
NO
"TIME OUT"
YES
ENABLE "SET TIME" KEY
C
B
DISABLE "START" KEY
LOAD ON
DECREMENT TIME @ 1 SECOND
TIME IS "00 00" ?
NO
YES
LOAD OFF
ENABLE "SET TIME" KEY
C
D
BAT LOW LED ON
V < BAT BAD ?
YES
CHARGER IS ON ?
NO
NO
YES
C
TURN ON BATTERY CHARGER
E
BAT LOW LED OFF
CHARGER IS ON ?
YES
NO
C
TURN ON BATTERY CHARGER The Countdown Timer, microprocessor's programmable memory is factory programmed by means of computer interface, wherein the programming files on the accompanying CD labeled "Countdown Timer Programming and Instuctions" Copy 1, are down loaded to the memory of the countdown timer, from a IBM-PC with a MS-Windows NT/2000/XP operating system, consisting of the following files;

Disk labeled: Countdown Timer Programming and Instructions Copy 1, written To disk on Dec. 15, 2005. Copy 2, written To disk on Dec. 15, 2005.

| | Date Modified: | Type of file: | File size: | Date loaded to disk: |
|---|---|---|---|---|
| Files on disk: | | | | |
| Cntdwntimr | Jul. 01, 2005 | C File | 16.5 KB | Dec. 15, 2005 |
| CntDwnTimr | Jun. 30, 2005 | ASM File | 50 KB | Dec. 15, 2005 |
| CntDwnTimr | Jun. 30, 2005 | INC File | 1 KB | Dec. 15, 2005 |
| cntdwntimr.c~ | Jun. 30, 2005 | C~File | 17 KB | Dec. 15, 2005 |
| CntDwnTimr.eep | Jun. 30, 2005 | EEP File | 1 KB | Dec. 15, 2005 |
| Cntdwntimr | Jun. 30, 2005 | H File | 4 KB | Dec. 15, 2005 |
| CntDwnTimr | Jun. 30, 2005 | Error Log | 1 KB | Dec. 15, 2005 |
| CntDwnTimr.cof | Jun. 30, 2005 | COF File | 7 KB | Dec. 15, 2005 |
| CntDwnTimr | Jun. 30, 2005 | OJB File | 8 KB | Dec. 15, 2005 |
| CntDwnTimr | Jun. 30, 2005 | Text Document | 5 KB | Dec. 15, 2005 |
| cntdwntimr.h~ | Jun. 30, 2005 | H~File | 4 KB | Dec. 15, 2005 |
| CntDwnTimr.hex | Jun. 30, 2005 | HEX File | 5 KB | Dec. 15, 2005 |
| CntDwnTimr.ls~ | Jun. 13, 2005 | LS~File | 75 KB | Dec. 15, 2005 |
| CntDwnTimr.lst | Jun. 30, 2005 | LST File | 80 KB | Dec. 15, 2005 |
| CntDwnTimr.map | Jun. 30, 2005 | MAP File | 2 KB | Dec. 15, 2005 |
| CntDwnTimr.pr~ | Jun. 27, 2005 | PR~File | 4 KB | Dec. 15, 2005 |
| CntDwnTimr.prj | Jun. 30, 2005 | PRJ File | 4 KB | Dec. 15, 2005 |
| CntDwnTimr.rom | Jun. 30, 2005 | ROM File | 11 KB | Dec. 15, 2005 |
| CntDwnTimr.vec | Jun. 30, 2005 | VEC File | 1 KB | Dec. 15, 2005 |
| CntDwnTimr_ | Jun. 30, 2005 | C File | 17 KB | Dec. 15, 2005 |
| CntDwnTimr_cof | Jun. 7, 2005 | APS File | 3 KB | Dec. 15, 2005 |
| swart | Jun. 6, 2005 | C File | 2 KB | Dec. 15, 2005 |
| swart | Jun. 8, 2005 | H File | 1 KB | Dec. 15, 2005 |
| swart | Jun. 8, 2005 | H~File | 1 KB | Dec. 15, 2005 |
| Firmware loading | | | | |
| instructions | Jun. 30, 2005 | Wordpad Document | 119 KB | Dec. 15, 2005 |
| _sp12dev | Jun. 20, 2005 | File | 33 KB | Dec. 15, 2005 |
| _sp12rc | Dec. 9, 2005 | File | 4 KB | Dec. 15, 2005 |
| decoder.eep | Jun. 18, 2005 | EEP File | 1 KB | Dec. 15, 2005 |
| decoder.hex | Jun. 18, 2005 | HEX File | 5 KB | Dec. 15, 2005 |
| giveio | Apr. 4, 1996 | System File | 6 KB | Dec. 15, 2005 |
| install | Sep. 27, 2003 | MS_DOS Batch File | 1 KB | Dec. 15, 2005 |
| instdrv | May 14, 1999 | Application | 157 KB | Dec. 15, 2005 |
| lock | Jun. 24, 2005 | MS_DOS Batch File | 1 KB | Dec. 15, 2005 |
| sp12 | Feb. 17, 2003 | Application | 58 KB | Dec. 15, 2005 |
| sp12 | Feb. 7, 2003 | Text Document | 48 KB | Dec. 15, 2005 |
| sp12dev | Jan. 28, 2003 | Text Document | 9 KB | Dec. 15, 2005 |
| uninstall | Sep. 27, 2003 | MS_DOS Batch File | 1 KB | Dec. 15, 2005 |
| upload | Jun. 30, 2005 | MS_DOS Batch File | 1 KB | Dec. 15, 2005 |

Figure 4:
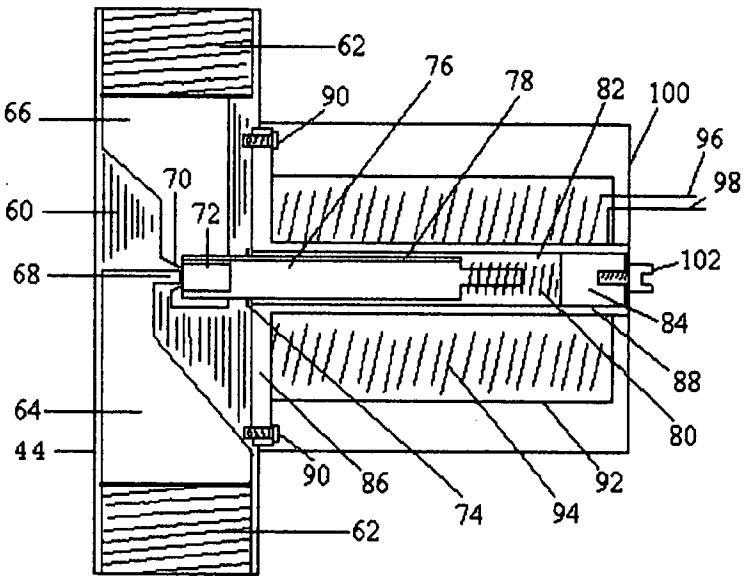
FIG. 4 is a cutaway front view of the supply shut off solenoid valve of the present invention.

FIG. 4 is a cutaway view of the solenoid safety valve 44, comprised of a valve body 60, consisting of an inlet chamber 64, and an outlet 66, externally or internally threaded to accept NPT 62, of a size necessary to connect to the water feed line of the toilet used. A flow port 68, of sufficient diameter allows the water flow between the inlet chamber 64, and the outlet chamber 66. At the outlet chamber end of the flow port 68, is a valve seat 70. A valve seal 72, stops the flow of water through said flow port 68, when in contact with said valve seat 70. The valve seal 72, is opened and closed by means of a valve shaft 76, to which it is permanently affixed. Said valve shaft 76, is made of material suitable to magnetic pull. Said valve shaft 76, moves towards a valve shaft end plug 84, made of suitable magnetizable material by means of an electromagnetic field generated within a valve shaft chamber 82, being forced closed by means of a valve shaft spring 80, when there is no power to created said electromagnetic field. Said valve shaft 76, is able to move into the open position easily without resistance due to back pressure reduction by means of a valve shaft flute 78, which allows the water at said plug end 84, to move freely towards said valve seal end 72. Said valve shaft chamber 82, is surrounded by a valve shaft chamber wall 88, and is molded to a valve shaft chamber base 86. Said chamber base 86, is mounted to said valve body 60, by means of four chamber base mounting screws 90, and sealed by means of an o-ring 74, of suitable material. An electromagnetic field is generated by means of a solenoid coil wire 94, of suitable gauge and length to create said field by means of winding said wire around a solenoid coil spool 92, and placing said coil spool 92 over the valve shaft chamber wall 88. To charge said coil 94, electric current of the proper voltage must be introduced by means of a positive lead wire 96, and a negative lead wire 98. Said solenoid coil wire 94, is covered by means of a solenoid coil casing 100, held in place by means of a solenoid casing screw 102. Said positive lead wire 96, and negative lead wire 98, pass through said solenoid coil casing for access to electrical current to create the electromagnetic field needed to open said valve seat 72.

Those skilled in the art will appreciate that various adaptations and modifications of the just-described preferred embodiments which can be configured without departing from the scope and spirit of the invention. Therefore, it is to be understood that, within the scope of the appended claims, the invention may be practiced other than as specifically described herein, such as use of a larger volume solenoid safety valve 44, on a tank-less toilet or urinal and using a push button to start the countdown in place of a tilt switch 36, to activate the flush cycle, or with any other electronically controllable device.

What I claim to be secured by Letters Patent of the United States is:

1. A countdown timer, automatic water limiting, supply shut off, safety valve flo-control system for use with toilets with or without tanks and urinals comprising;

a countdown timer enclosure mountable to any flat surface, a circuit board mounted within said enclosure, an electronic circuit attached to said circuit board, a microprocessor memory component incorporated in said circuit, a battery mounted within said enclosure, a regulator within said circuit for regulating charging voltage, and operating voltage, electrically connected to a wall transformer, as a source for power to charge said battery, a power on indicator, a charge indicator, a low battery indicator, a set button switch, a minute button switch, a second button switch, a run time settable anode type 7-segment display, to display programming, and run time set for said countdown timer, a start switch for starting said countdown timer, a twisty wire for attaching said start switch to an existing toilet flush control lever, an electrically connected and controlled normally closed safety valve flo-control for stopping and permitting water flow, an inlet for connecting said electrically controllable safety valve flo-control to the existing water feed line of a toilet or urinal providing a connection to a source of water under pressure, an outlet for connecting said electrically controllable safety valve flo-control to the inlet of a toilet or urinal by means of the existing water feed line, a normally closed plunge stopper centrally positioned for preventing water flow through said safety valve flo-control when not activated.

2. The countdown timer, automatic water limiting, supply shut off, safety valve flo-control system of claim 1 wherein external components of said countdown timer enclosure are composed of suitable materials.

3. The countdown timer, automatic water limiting, supply shut off, safety valve flo-control system of claim 1 wherein certain internal components of said system are composed of suitable electronic parts and materials.

4. The countdown timer, automatic water limiting, supply shut off, safety valve flo-control system of claim 1 wherein said microprocessor memory component is comprised of suitable capacity.

5. The countdown timer, automatic water limiting, supply shut off, safety valve flo-control system of claim 1 wherein said microprocessor memory component, is turned on and programmed by means of said set button switch, said minute button switch, and said second button switch, which are labeled set, min, and sec.

6. The countdown timer, automatic water limiting, supply shut off, safety valve flo-control system of claim 1 wherein said programming display has four common anode type 7-segment displays, to display the minutes, and seconds, multiplexed by;

a set of four transistors, the seven segments are connected to the microprocessor memory component by means of a group of current limiting resistors, comprised of suitable resistance.

7. The countdown timer, automatic water limiting, supply shut off, safety valve flo-control system of claim 1 wherein said microprocessor memory component is comprised of suitable capacity.

8. The countdown timer, automatic water limiting, supply shut off, safety valve flo-control system of claim 1 wherein said battery is comprised of suitable voltage.

9. The countdown timer, automatic water limiting, supply shut off, safety valve flo-control system of claim 1 wherein said regulator within the circuit for regulating charging voltage is of suitable voltage to charge said battery, by means of vower supplied from a wall transformer.

10. The countdown timer, automatic water limiting, supply shut off, safety valve flo-control system of claim 1 wherein charging is monitored by means of said charge indicator, and said low battery indicator.

11. The countdown timer, automatic water limiting, supply shut off, safety valve flo-control system of claim 1 wherein said start switch is a suitable electronic switch.

12. The countdown timer, automatic water limiting, supply shut off, safety valve flo-control system of claim 1 wherein said safety valves external housing is composed of suitable non-corrosive materials.

13. The countdown timer, automatic water limiting, supply shut off, safety valve flo-control system of claim 1 wherein internal components of said safety valve, and said plunge stopper are composed of suitable non-corrosive, magnetically moveable electronic materials.

14. The countdown timer, automatic water limiting, supply shut off, safety valve flo-control system of claim 1 wherein components of said electronic circuit are composed of suitable electrical materials.

15. The countdown timer, automatic water limiting, supply shut off, safety valve flo-control system of claim 1 wherein said safety valve is connectively threaded at its upper most outlet by means of a outlet compression fitting connected to the existing water feed tube thereby mounting said control valve to the existing flush valve mounted to the tank of a toilet or urinal.

16. The countdown timer, automatic water limiting, supply shut off, safety valve flo-control system of claim 1 wherein said safety valve is connectively threaded at its lower most inlet by means of a inlet compression fitting connected to the existing water feed tube for providing a connection to a source of water under pressure, whereby, said countdown timer, automatic water limiting, supply shut off, safety valve flo-control system will activate by means of said start switch causing a settable countdown to electrically power open and hold open said safety valve for a settable and re-programmable length of time thereby allowing flow of water to facilitate the flushing cycle of a toilet of any tank capacity by volume, and allow closing of said safety valve when said countdown reaches 00 00 and terminating electrical power to said valve thereby limiting a certain amount of water by volume to pass to the toilet and providing positive shutoff of the water, after which said countdown timer will reset for the next flush cycle, when closed said countdown timer, automatic water limiting, supply shut off, safety valve flo-control system doubles as a back flow prevention device, the countdown timer, automatic water limiting, supply shut off, safety valve flo-control system will limit a certain amount of water by volume per flush, prevent wasting of water, overflow, anti-siphoning, and backflow of water from a toilet.

* * * * *